US008308853B2

(12) United States Patent
Bender et al.

(10) Patent No.: US 8,308,853 B2
(45) Date of Patent: Nov. 13, 2012

(54) GATE OR DAMPER STRUCTURE IN WET ELECTROSTATIC PRECIPITATOR

(75) Inventors: Carl W. Bender, Wellesley (CA); William A. L. Gamble, Kitchener (CA)

(73) Assignee: Turbo Sonic Inc., Waterloo, Ontario (CA)

( * ) Notice: Subject to any disclaimer, the term of this patent is extended or adjusted under 35 U.S.C. 154(b) by 141 days.

(21) Appl. No.: 12/597,076

(22) PCT Filed: Apr. 23, 2008

(86) PCT No.: PCT/CA2008/000752

§ 371 (c)(1), (2), (4) Date: Oct. 22, 2009

(87) PCT Pub. No.: WO2008/128353

PCT Pub. Date: Oct. 30, 2008

(65) Prior Publication Data

US 2010/0058928 A1 Mar. 11, 2010

Related U.S. Application Data

(60) Provisional application No. 60/907,919, filed on Apr. 23, 2007.

(51) Int. Cl.
*B03C 3/70* (2006.01)

(52) U.S. Cl. ..... 96/83; 96/88

(58) Field of Classification Search ..... 96/43–50, 96/52, 53, 83, 88

See application file for complete search history.

(56) References Cited

U.S. PATENT DOCUMENTS

| | | | | | |
|---|---|---|---|---|---|
| 2,567,709 | A | | 9/1951 | Hedberg | |
| 2,720,551 | A | * | 10/1955 | Wastvind et al. | 96/88 |
| 2,794,847 | A | * | 6/1957 | Streuber et al. | 174/18 |
| 2,806,896 | A | | 9/1957 | Streuber et al. | |
| 3,595,983 | A | * | 7/1971 | Muller et al. | 174/31.5 |
| 3,765,154 | A | * | 10/1973 | Hardt et al. | 96/88 |
| 4,117,255 | A | * | 9/1978 | Kawaike et al. | 96/50 |
| 4,177,047 | A | * | 12/1979 | Goland | 96/88 |
| 4,251,682 | A | * | 2/1981 | Ebert et al. | 95/57 |
| 4,294,591 | A | * | 10/1981 | Kahl | 96/43 |
| 4,439,216 | A | | 3/1984 | Perryman | |
| 4,522,634 | A | | 6/1985 | Frank | |
| 4,846,857 | A | * | 7/1989 | Tachibana | 96/74 |
| 4,908,047 | A | * | 3/1990 | Leonard | 95/71 |
| 5,482,540 | A | * | 1/1996 | Trinward et al. | 95/57 |
| 6,176,902 | B1 | * | 1/2001 | Matsubara | 96/66 |
| 2004/0226449 | A1 | * | 11/2004 | Heckel et al. | 96/88 |

FOREIGN PATENT DOCUMENTS

| | | | | | |
|---|---|---|---|---|---|
| JP | 1-258754 | A | * | 10/1989 | 96/88 |

* cited by examiner

*Primary Examiner* — Richard L Chiesa

(74) *Attorney, Agent, or Firm* — Michael I. Stewart; Sim & McBurney

(57) ABSTRACT

A damper arrangement is described which provides for selective separation of the insulator compartments from the main body of a wet electrostatic precipitator (WESP), permitting maintenance to be performed on the insulator in the compartment while process gas continues to flow through the WESP.

3 Claims, 6 Drawing Sheets

GATE OR DAMPER STRUCTURE IN WET ELECTROSTATIC PRECIPITATOR

REFERENCE TO RELATION APPLICATIONS

This application is a U.S. National Phase filing under 35 USC 371 of PCT/CA2008/000752 filed Apr. 23, 2008 claiming priority under 35 USC 119(e) from U.S. Provisional Patent Application No. 60/907,919 filed Apr. 23, 2007.

FIELD OF INVENTION

The present invention is concerned with access to insulators in a wet electrostatic precipitator (WESP) to perform insulator maintenance by the use of a gate or damper structure.

BACKGROUND OF THE INVENTION

WESPs have been used for many years to remove dust, acid mist and other particulates from water-saturated air and other gases by electrostatic means. In a WESP, particulate and mist laden gas flows between discharge and collecting electrodes, where the particulate and mist are charged by a high intensity corona emitted from the high voltage discharge electrodes. As the gas flows further within the WESP, the charged particulate matter and mist is electrostatically attracted to grounded collecting plates or electrodes, where it is collected. The collected materials are washed off by an irrigation film of water.

The design of the WESP utilizes negatively charged high voltage discharge electrodes separated from the grounded collecting electrodes by porcelain or ceramic insulators. The insulators are mounted external to the process gas stream. This type of system is used to remove pollutants from various industrial gas streams, such as chemical incinerators, coke ovens, ceramic brick furnaces, coal fired power plants, multi-fuelled power plant, food drying plants, non-ferrous metallurgical plants and petrochemical plants.

In certain industries, such as the petrochemical industry, a WESP is required to be operating for long periods of time, generally up to 60 months, and cannot be shut down for maintenance. This extended period of operation raises problems with overall maintenance, but especially insulator maintenance.

SUMMARY OF INVENTION

The present invention provides a system which provides access to insulators on a WESP to enable maintenance to be performed on the insulator, while process gas continuously passes through the WESP.

In this regard, a gate or a damper arrangement is used to isolate the insulator from the process gas while the insulator compartment under maintenance is de-energized and locked out.

In accordance with one aspect of the present invention, there is provided, in an electrostatic precipitator having a body and a grid of electrode elements within the body, a plurality of electro-conducting support arms connected to and supporting the grid, each of said support arms extending through a port in a wall of the electrostatic precipitator surrounding the grid of electrode elements to an external insulator compartment and terminating on an insulator which insulates the support arm from the body of the electrostatic precipitator, the improvement which comprises a damper located in the insulator compartment and effective to selectively seal off the interior of the insulator compartment from gases flowing through the electrostatic precipitaror.

GENERAL DESCRIPTION OF THE INVENTION

The blades of the damper arrangement may be a sliding type or a swinging gate type to close off the high voltage frame opening into the WESP. The blades can be manually operated or operated with an automatic actuator.

To ensure a man-safe environment, close tolerances must be maintained between the damper blade and the high voltage (HV) support frame. A flexible seal may be used to reduce air leakage.

Alternatively, a double-walled damper with sealing air that has a higher pressure than the process gas may be used to prevent process gas from entering the insulator compartment and to allow a positive seal pressure around the HV support frame. An adjusting mechanism may be used on the damper blades so that, when the damper blades are actuated, the HV support frames are re-aligned to their correct position, in case any movement or shifting has occurred due to a failure of the insulator. Reference points may be used to determine the correct position of the HV frame relative to its position at commissioning, or when the latest internal maintenance was performed.

An inspection port or window may be used to view the damper position before opening the access door.

For operator safety, key interlocks may be used to ensure that the damper position cannot be changed while the WESP is de-energized.

DESCRIPTION OF PREFERRED EMBODIMENT

Figure 1:
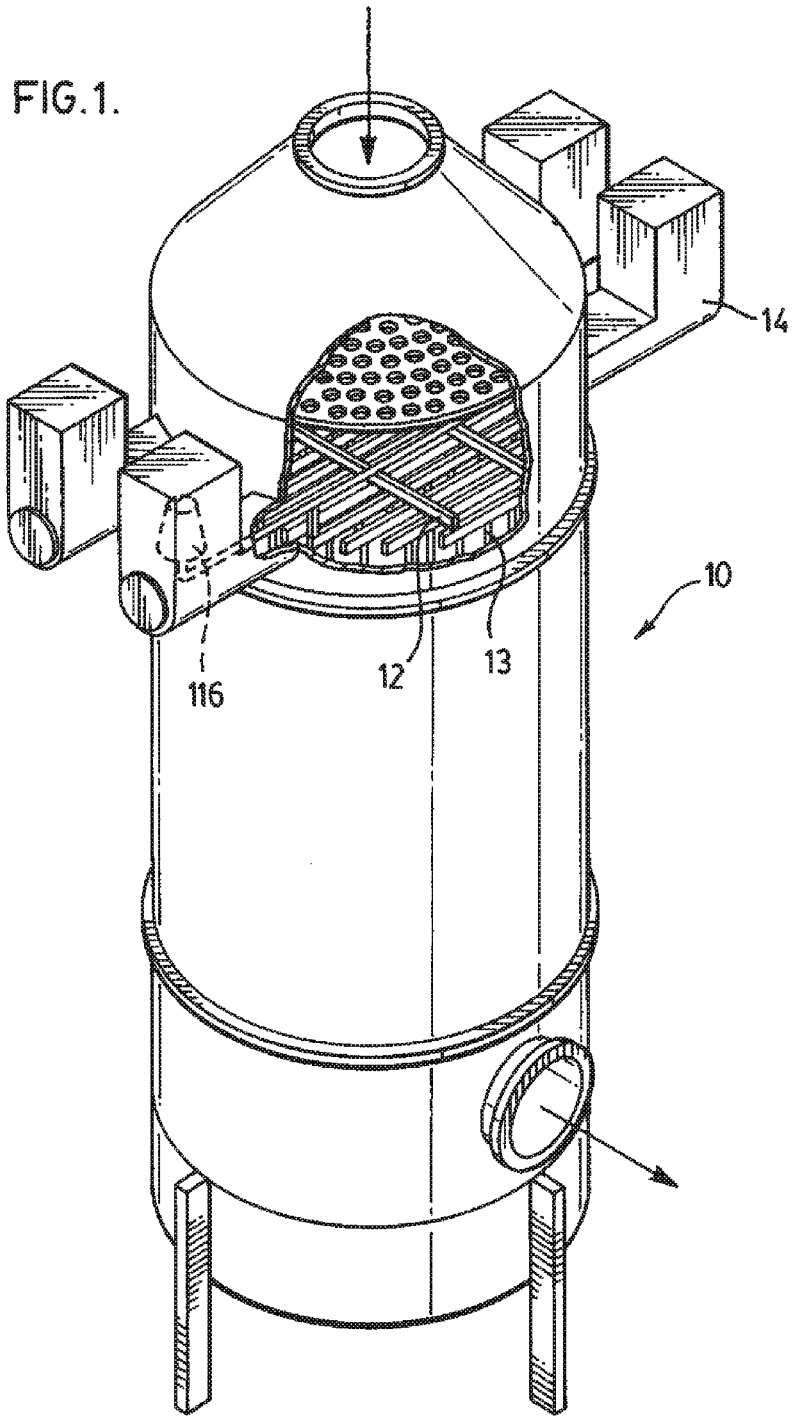
FIG. 1 is a general perspective view with parts cut away of a wet electrostatic precipitator.

Referring to the drawings, FIG. 1 shows a typical WESP structure 10 with parts cut-away to show a high voltage frame 12 which supports the electrodes 13 of the WESP. The WESP structure 10 includes insulator compartments 14 containing insulators 16.

Figure 2:
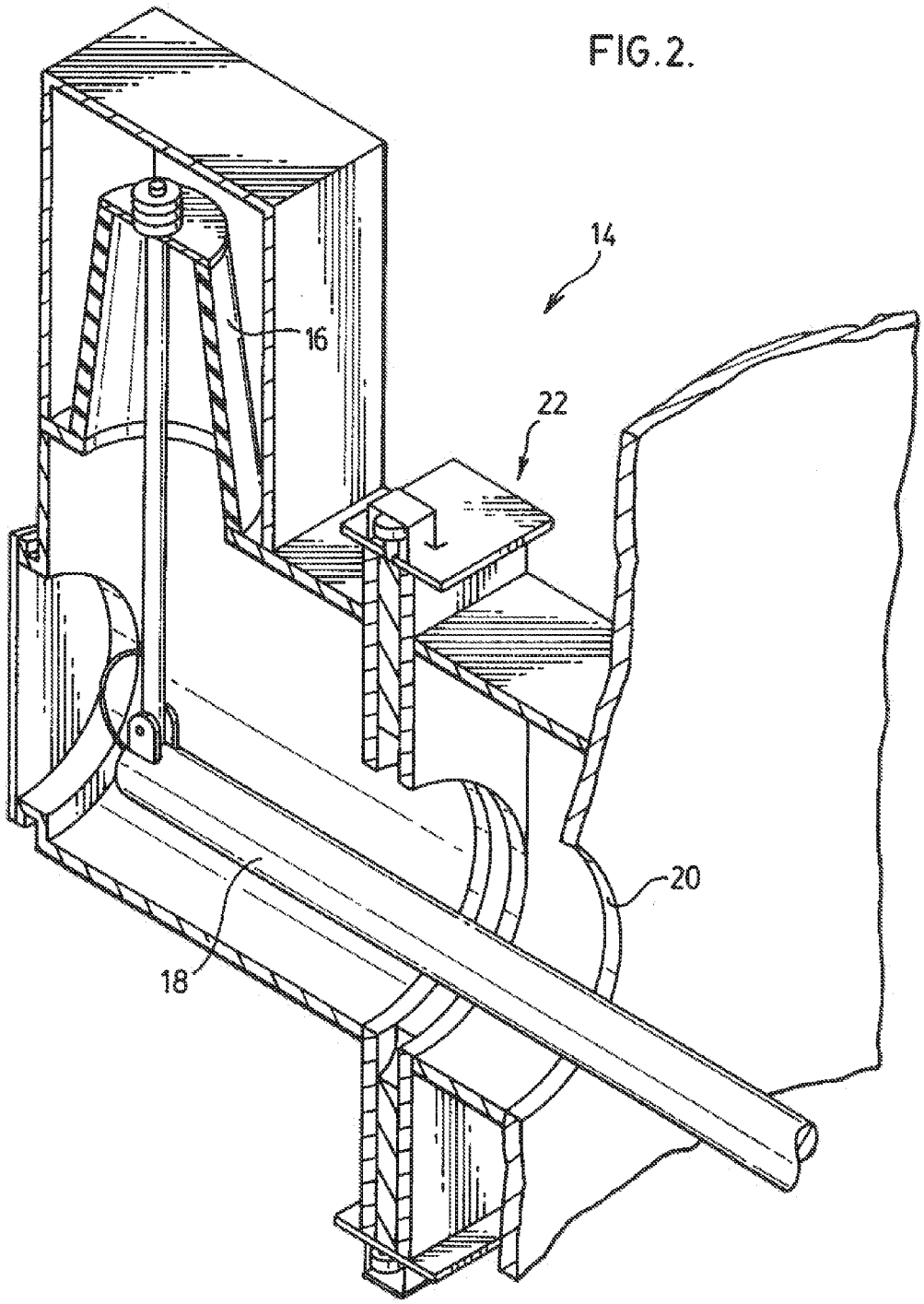
FIG. 2 is a close up perspective view of a portion of the wet electrostatic precipitator of FIG. 1, showing details of the gate structure provided in accordance with one aspect of the present invention.
Figure 3:
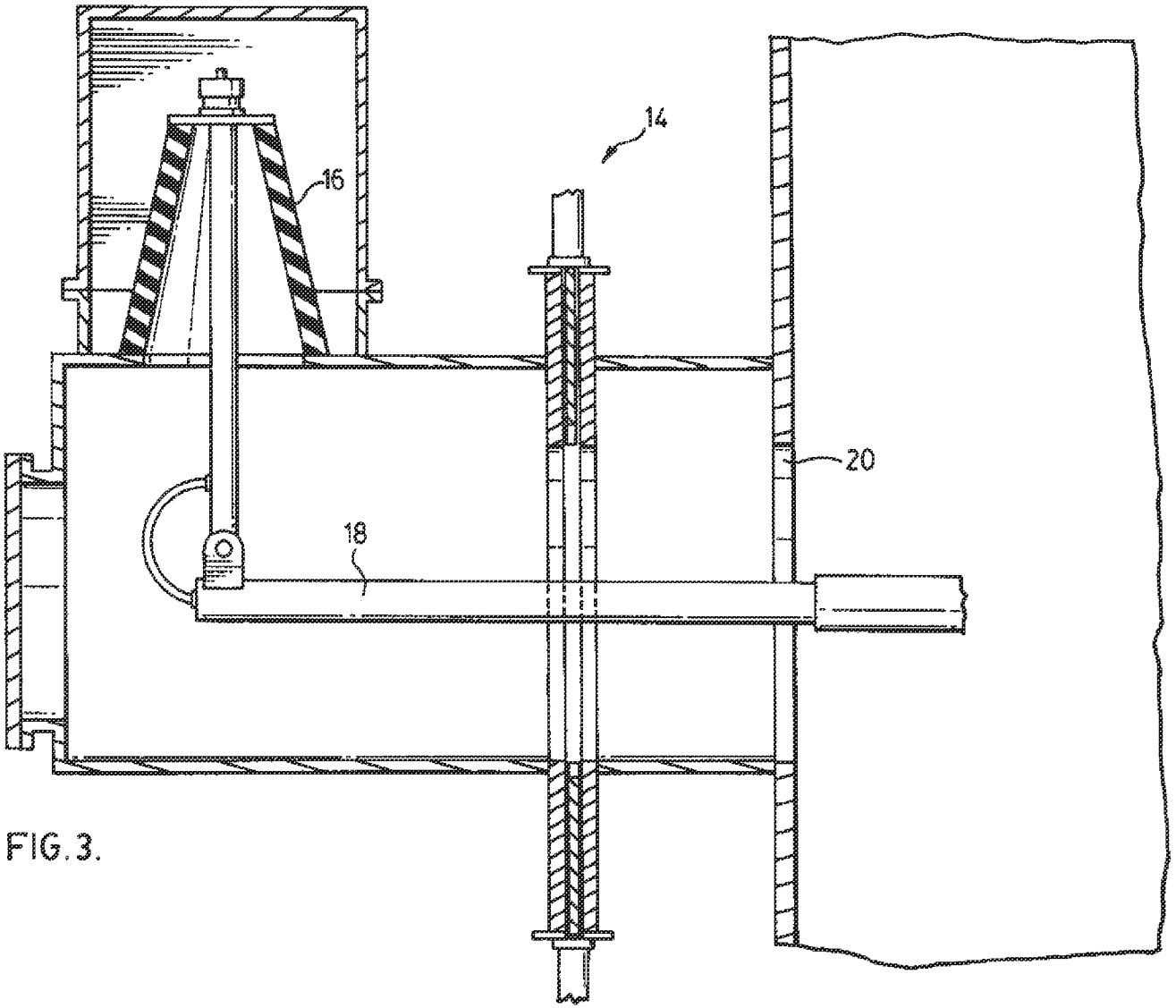
FIG. 3 is a sectional view of FIG. 2.

FIGS. 2 and 3 are respectively perspective and sectional views of a detail of the insulator compartment 14 containing the insulators 16. As may be seen, the insulator 16 supports an end of element 18 of the high voltage frame 12. The insulator component 14 generally is in fluid flow communication with the process gas stream passing through the WESP through an opening 20 in the wall of the WESP.

In accordance with the present invention, there is provided a damper arrangement 22 which enables the insulator compartment 14 to be isolated from the WESP 10. As may be seen, the damper arrangement 22 comprises a pair of gates elements 24 and 26, which slidably move from the open position (FIGS. 4A and 5A) towards each other by any suitable mechanism to engage and surround the end element 18 in the closed position (FIGS. 4B and 5B), thereby closing off the insulator compartment 14 from the gases flowing through the WESP.

Figure 6:
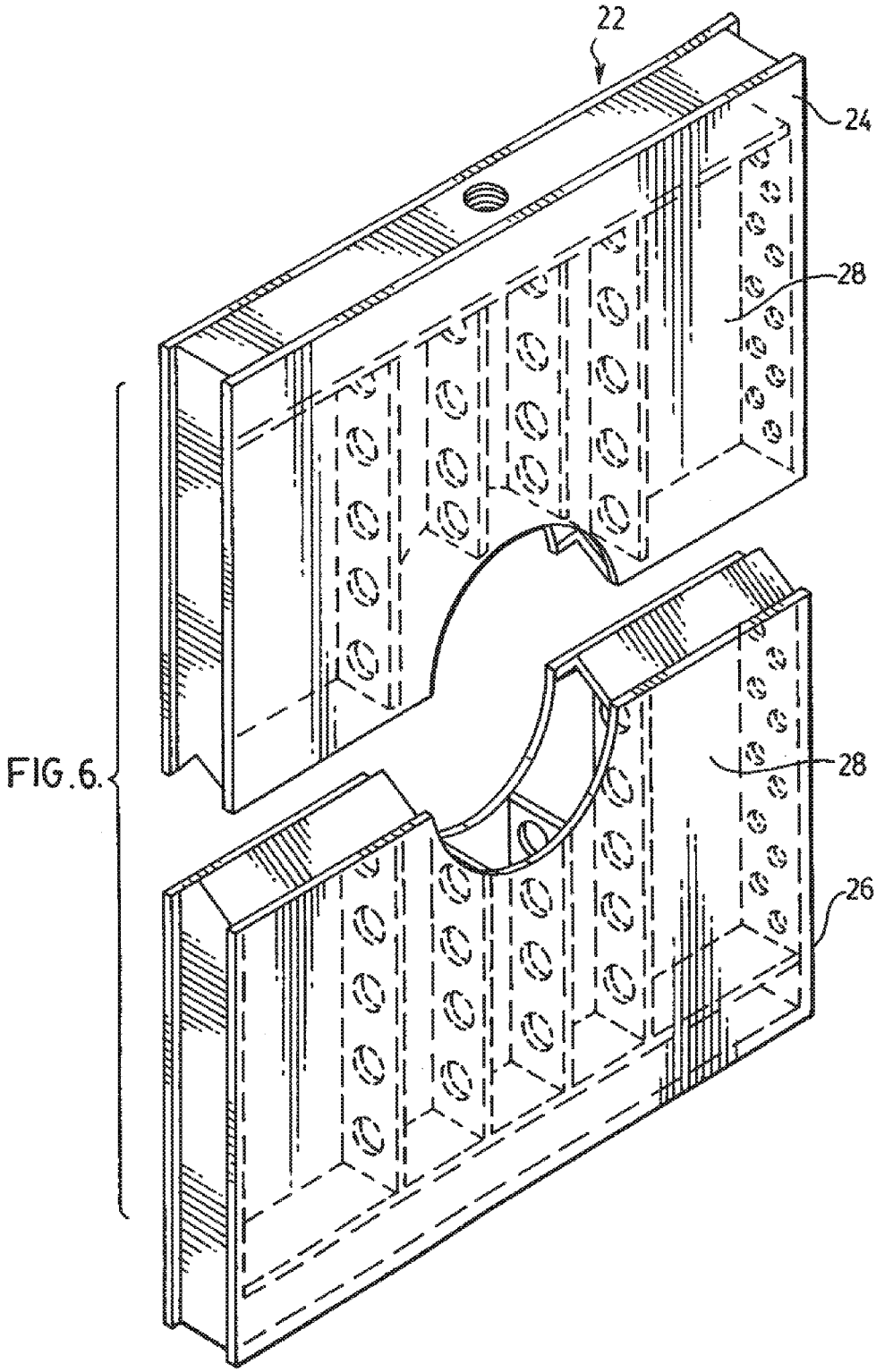
FIG. 6 is a detailed perspective view of a double-walled gate structure according to one embodiment of the present invention.

In their closed position, the gate elements 24 and 26 preferably define a hollow cavity 28 into which purge air having a higher pressure than the process gas may be flowed to completely seal off the process gas from the insulator compartment 14. This arrangement is illustrated in FIG. 6.

De-energizing of the end element 18 is effected prior to closing the damper arrangement 22. Access to the insulator component 14 then may be safely made for maintenance of the insulator 16 while process air continues to flow through the WESP 10.

Figure 4A:
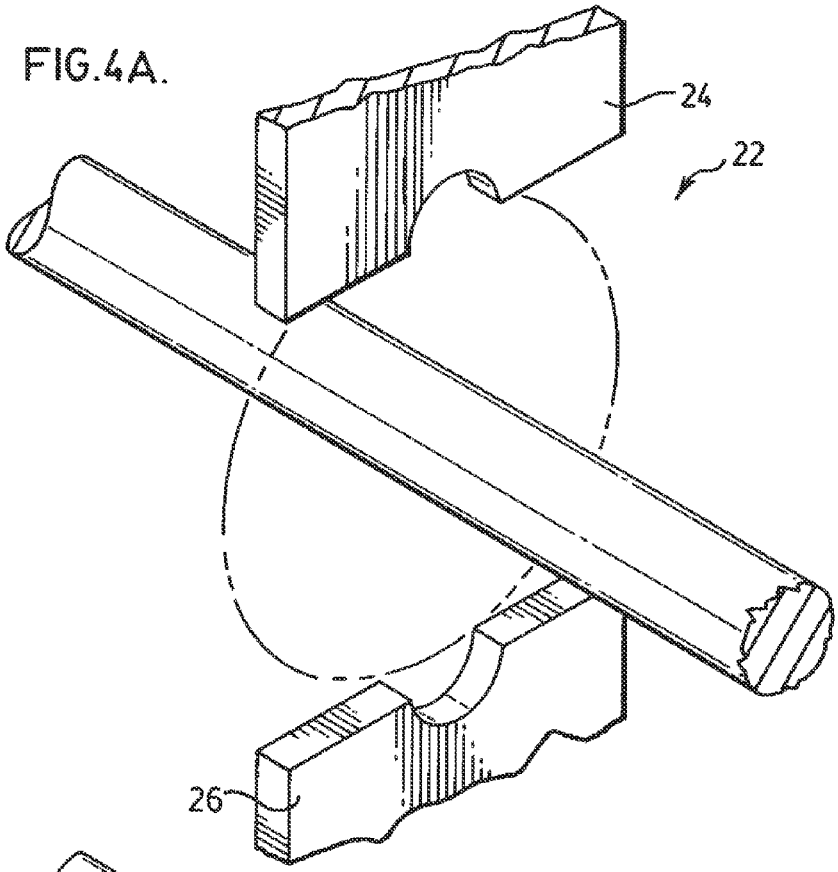
FIG. 4 contains a close up perspective view of the gate structure of one embodiment of the present invention in the open (FIG. 4A) and closed (FIG. 4B) positions.
Figure 4B:
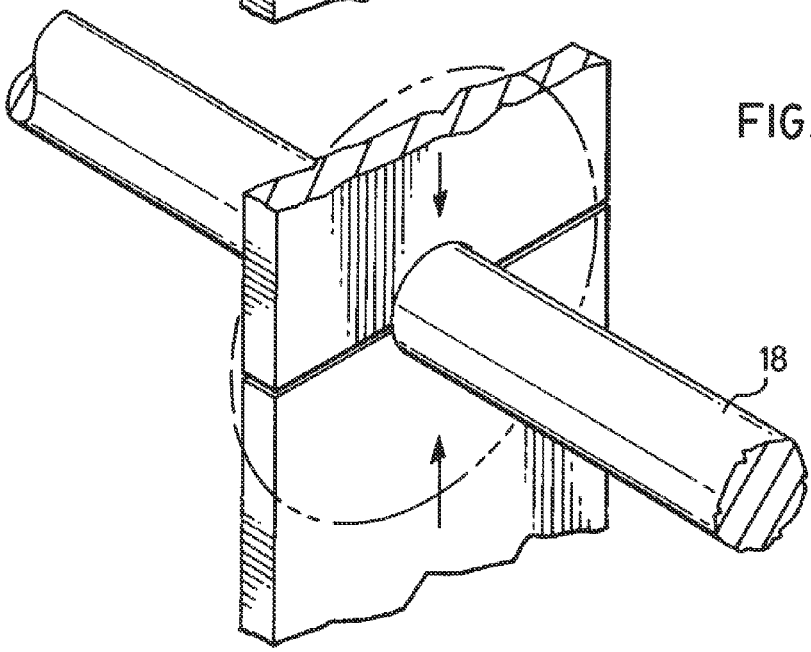
Figure 5A:
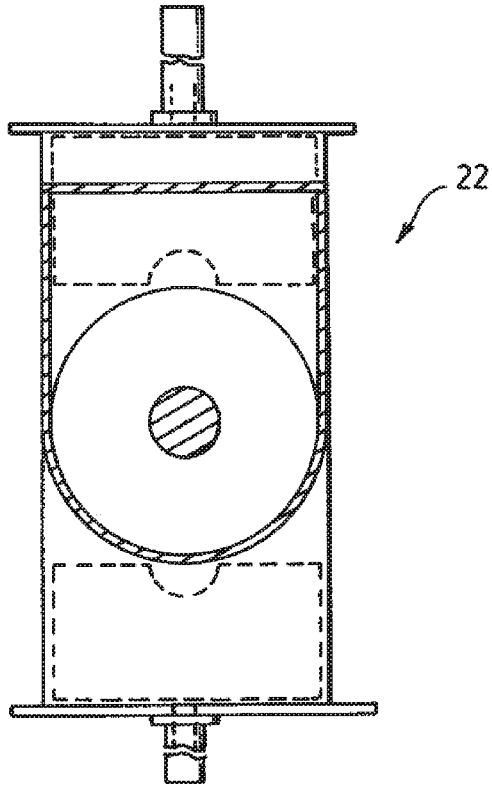
FIG. 5 is a front elevational view of the gate structure of FIG. 3 in the open (FIG. 5A) and closed (FIG. 5B) positions.
Figure 5B:
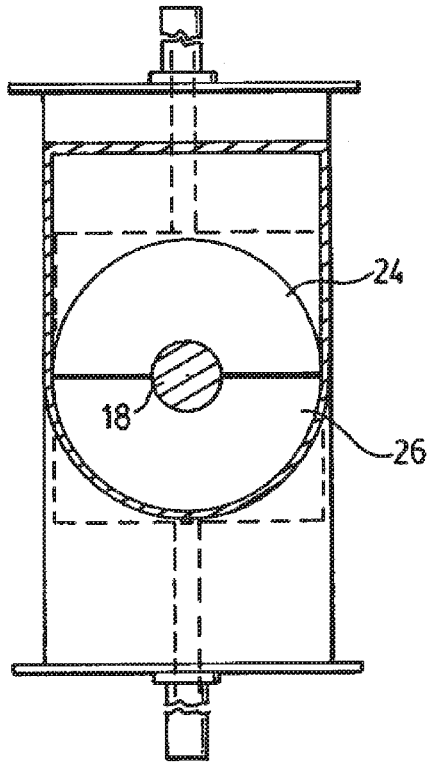

When service to the insulator compartments is complete, the gate elements are opened by withdrawing them to their retracted positions (FIGS. 4A and 5A). Normal operation of the WESP is resumed.

SUMMARY OF THE INVENTION

In summary of this disclosure, there is provided a gate or damper arrangement that provides selective separation of the insulator compartment from the main body of the WESP, thus allowing maintenance to be performed on the insulator, while process gas continues to flow through the WESP. Modifications are possible within the scope of the invention.

The invention claimed is:

1. An electrostatic precipitator having a body and a grid of electrode elements within said body, a plurality of electroconducting support arms connected to and supporting the grid, each of said support arms extending through a port in a wall of the electrostatic precipitator surrounding said grid of electrode elements to an external insulator compartment and terminating in an insulator which insulates the support arm from the body of the electrostatic precipitator, and a damper located in the insulator compartment and effective to selectively seal off the interior of the insulator compartment from gases flowing through the electrostatic precipitator, wherein said damper comprises a wall spanning the insulator compartment and defining respective openings through which each of said support arms extend and at least one closure element selectively moveable between a first position in which said opening is at least partially unobstructed and a second position in which the opening is completely obstructed.

2. The electrostatic precipitator of claim 1 wherein said closure element comprises a pair of plates moveable into and off of engagement with each other and encasing said respective support arm.

3. The electrostatic precipitator of claim 2 wherein one of said pair of plates comprises first and second spaced-apart plates, whereby, when said pair of plates is in said engagement position, said first and second spaced apart plates define a cavity into which pressurized air at a pressure greater than the process gas may be passed to ensure a hermetic seal with the support arm.

* * * * *